United States Patent [19]

Kelly

[11] 4,359,889

[45] Nov. 23, 1982

[54] SELF-CENTERING SEAL FOR USE IN HYDRAULICALLY EXPANDING TUBES

[75] Inventor: John W. Kelly, Burbank, Calif.

[73] Assignee: Haskel Engineering & Supply Company, Burbank, Calif.

[21] Appl. No.: 133,010

[22] Filed: Mar. 24, 1980

[51] Int. Cl.[3] ..... B21D 22/00

[52] U.S. Cl. ..... 72/62; 29/157.3 C; 29/421 R; 277/59; 277/188 A; 277/190; 285/99; 285/110

[58] Field of Search ..... 72/62; 29/157.3 C, 157.4, 29/421 R, 727; 285/99, 110; 277/116.6, 116.8, 3, 27, 188 A, 190, 191, 59

[56] References Cited

U.S. PATENT DOCUMENTS

| | | | |
|---|---|---|---|
| 2,272,811 | 2/1942 | Nathan | 285/110 X |
| 2,508,286 | 5/1950 | Otis | 277/116.6 X |
| 2,903,310 | 9/1959 | Hill | 277/188 A X |
| 3,602,520 | 8/1971 | Wallis | 277/27 |
| 3,738,665 | 6/1973 | Bilco | 272/27 X |
| 3,977,068 | 8/1976 | Krips | 29/421 R |
| 3,979,810 | 9/1976 | Krips et al. | 29/727 |
| 3,982,765 | 9/1976 | Fickelscher | 277/53 |
| 4,069,573 | 1/1978 | Rogers, Jr. | 29/157.3 C |
| 4,123,068 | 10/1978 | Gorden | 277/27 |
| 4,169,605 | 10/1979 | Nishimoto | 277/188 A |

*Primary Examiner*—Leon Gilden

*Attorney, Agent, or Firm*—Fulwider, Patton, Rieber, Lee & Utecht

[57] ABSTRACT

In a device for confining a pressurized working fluid within a tube to be expanded radially, a support to be positioned axially within the tube and at least one sealing member encircling the support. The sealing member is deformable so that it expands radially against the inside of the tube upon axial compression by the force of a pressurized working fluid introduced into the tube. A centering means is provided that prevents angular movement of the sealing member relative to the longitudinal axis of the tube, thereby forcing the sealing member to assume a radially centered position within the tube as it expands.

11 Claims, 6 Drawing Figures

SELF-CENTERING SEAL FOR USE IN HYDRAULICALLY EXPANDING TUBES

FIELD OF THE INVENTION

The present invention relates to devices for radially expanding tubes and, more particularly, to such devices that utilize a pressurized working fluid to achieve the expansion.

BACKGROUND OF THE INVENTION

There are a variety of situations in which it is desired to expand a metal tube radially to form a tight, leak-free joint. For example, large heat exchangers, particularly the type used as steam generators in nuclear power plants, often employ a tube sheet, which is a metal plate several feet in thickness through which hundreds of stainless steel or carbon steel tubes must pass. The tube sheet is initially fabricated with holes of a suitable diameter in which the tubes are inserted. The tubes are then expanded against the sides of the holes by plastic deformation to seal the small crevices that would otherwise exist around the tubes. If these crevices were allowed to remain, they could collect corrosive agents, and would, therefore, decrease the predictable life-expectancy of the equipment.

The traditional technique for expanding tubes radially within the holes of tube sheets employs mechanical rolling. There are, however, a number of significant disadvantages associate with this technique. For example, mechanical rolling causes elongation of the tube with an accompanying decrease in the thickness of the tube walls. In addition, it is a time consuming process that is difficult to employ in the case of longer tubes. The use of rolling also imposes a minimum dimension on the inside diameter of the tube in relation to the tube wall thickness, since it must be possible to insert rollers of suitable strength and rigidity.

For the above reasons, efforts have been made to develop techniques for expanding tubes by the application of fluid pressure. According to this newer technique, a mandrel is inserted in the tube and a pressurized working fluid is introduced through the mandrel into a small annular space between the mandrel and the tube. Fluid must be confined within the tube between two seals that surround the mandrel.

It has been found that the most effective seal consists of an O-ring, which interfaces directly with the working fluid, and a more rigid but still elasticity deformable back-up member behind the O-ring. As the back-up member is compressed axially, it expands radially against the inside of the tube.

It is necessary to find a material for this back-up member that has the necessary combination of hardness and elasticity, but does not deform plastically under high pressure. When plastic deformation takes place, it is often because the gap, the annular space between the mandrel and the tube, is too large, permitting a portion of the back-up member to be extruded into the gap. For this reason the gap between the mandrel and the tube is referred herein as the "extrusion gap."

It is generally possible, working with tolerances that are acceptable in this type of apparatus, to maintain an extrusion gap within satisfactory dimensional limits, provided that the gap is substantially uniform about the circumference of the tube. However, the mandrel tends to be positioned along the surface of the tube, thus producing a gap of double thickness at the top of the mandrel. It is in this area of double thickness that plastic deformation of the back-up member is generally found to occur.

It is an objective of the present invention to provide an improved sealing device that causes the extrusion gap to be substantially uniform, thereby minimizing problems of plastic deformation of sealing members.

SUMMARY OF THE INVENTION

The present invention relates to a device that accomplishes the above objective. It includes a support, preferably a mandrel, to be positioned axially within a tube to be expanded and at least one sealing member encircling the support that is compressed axially and expanded radially upon the application of pressure thereto by a working fluid. A centering means is provided for preventing angular movement of the sealing member relative to the longitudinal axis of the tube, thereby forcing the sealing member to assume a radially centered position within the tube as the sealing member expands. In this way, a substantially uniform circumferential extrusion gap is provided adjacent to the sealing member.

Preferably, the centering means is in the form of a sleeve that is axially sideable on the support. The sleeve may have a flange that extends radially outwardly to confine the sealing member.

In a particularly advantageous form of the invention, the mandrel includes a portion of reduced diameter in which two sealing members can be disposed. The first is an O-ring, whereas the second is a back-up member. The back-up member encircles the sleeve and is confined axially between the flange of the sleeve and an abutment defined by the mandrel at one end of the reduced diameter portion. It is most advantageous to employ two seals of this construction, with the working fluid being supplied by a passage within the mandrel opening at one or more locations between the seals.

Other features and advantages of the present invention will become apparent from the following detailed description taken in conjunction with the accompanying drawings, which illustrate, by way of example, the principles of the invention.

DETAILED DESCRIPTION

Figure 1:
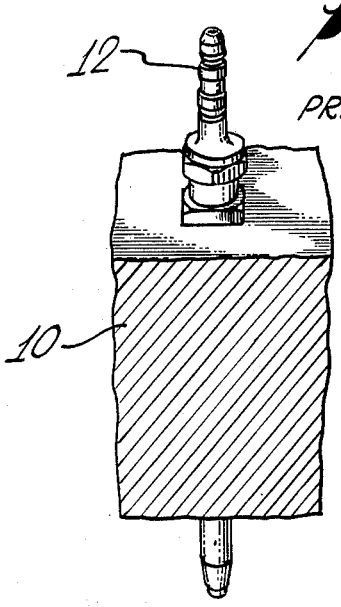
Fig. 1 PRIOR ART
FIG. 1 is a perspective view of a fragmentary portion of a tube sheet through which a mandrel has been inserted.
Figure 2:
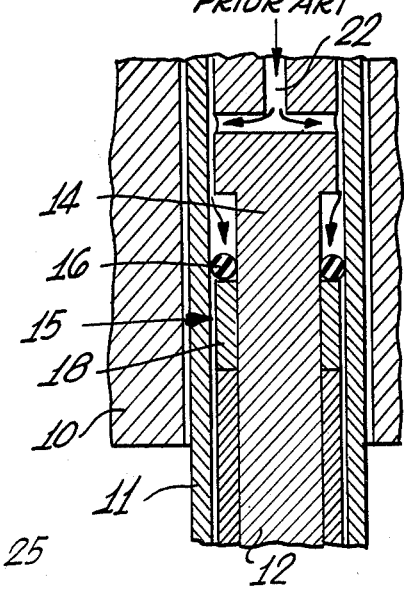
Fig. 2 PRIOR ART
FIG. 2 is an enlarged cross-sectional fragmentary view of such a mandrel inserted in a tube and tube sheet, showing a prior art seal construction for confining the working fluid, the seal being illustrated in the centered position it assumes before the application of working fluid pressure.
Figure 3:
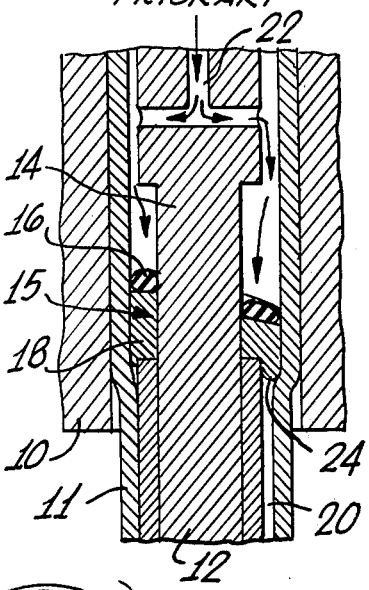
Fig. 3 PRIOR ART
FIG. 3 is view of the mandrel and seal of FIG. 2 after the pressure has been applied, the mandrel being shown in an off-center position.

A tube sheet 10, has a plurality of openings therein in which tubes 11 have been inserted. In accordance with known technology, and as illustrated in FIGS. 1–3 of the accompanying drawings, a mandrel 12 is inserted sequentially in each tube 11 to expand the tube into firm contact with the inner surface of the corresponding opening. In the fragmentary view of FIG. 1, only one representative opening, filed by the mandrel 12, is included, and the internal tube 11 is not visible.

The mandrel 12, being of a previously known construction, has, at each end, a portion 14 of reduced diameter in which a sealing device 15 is located (see FIG. 2) The sealing device 15 consists of an O-ring 16 on the high pressure side and a back-up member 18 on the low pressure side.

The back-up member 18, which is cylindrical, is preferably formed of elastically deformable polyurethane which has desired memory characteristics. However, there are limits beyond which the back-up member 18 will deform plastically, thus destroying or reducing the effectiveness of the seal 15 when used again in another tube.

Plastic deformation of the back-up member 18 is illustrated in FIG. 3. As shown there, the mandrel 12 has moved to one side of the tube 11, producing a crescent shaped extrusion gap 20 between the mandrel and the tube. On one side of the mandrel (to the right in FIG. 3), the gap 20 has twice the thickness that it would have if the mandrel 12 were centered in the tube 11. When pressurized working fluid, preferably water, is applied through a passage 22 in the mandrel 12, the back-up member 18 is extruded into the enlarged portion of gap 20 and deforms. This deformation results from a protrusion 24 on the edge of the back-up member 18 that extends into the extrusion gap 20 when the elastic limits of the material are exceeded.

Figure 4:
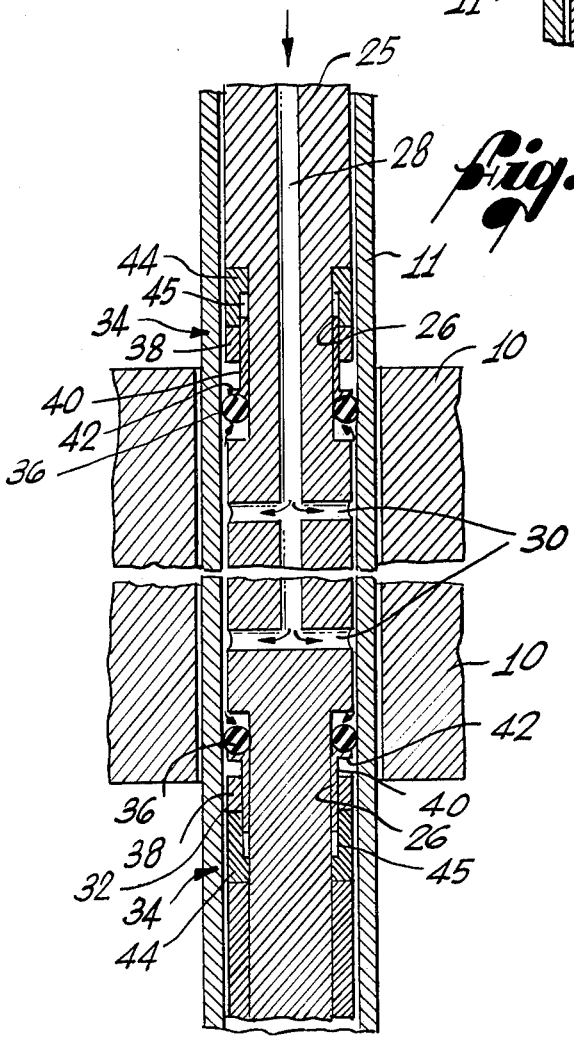
FIG. 4 is an enlarged, cross-sectional, fragmentary view of a mandrel and two seals constructed in accordance with the present invention, the seals at both ends of the mandrel being shown, but the center portion of the mandrel being omitted.
Figure 6:
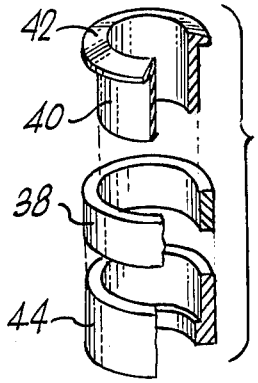
FIG. 6 is an expanded perspective view of a portion of the mandrel structure and the back-up member and sleeve of the seal from FIGS. 4 and 5, parts of the components being broken away to expose their cross-sectional configuration.
Figure 5:
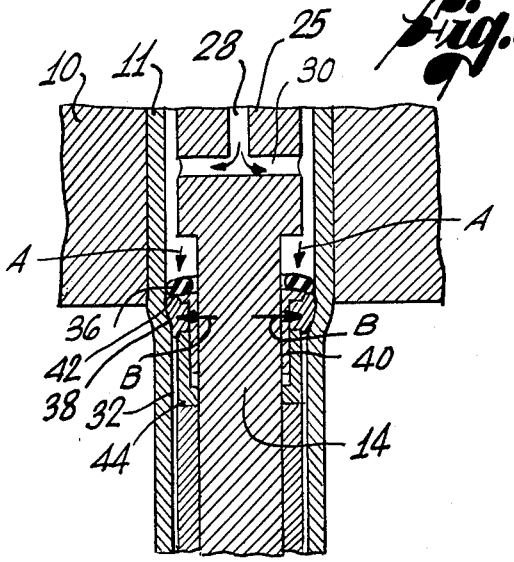
FIG. 5 is another enlarged, cross-sectional fragmentary view showing only the lower portion of the mandrel illustrated in FIG. 4, this view being taken after the fluid pressure has been applied.

An improved mandrel 25 is constructed in accordance with the present invention and shown in FIGS. 4 and 5. When inserted in the tube sheet 10, this new mandrel 25 has the same appearance as the previously known mandrel 12 illustrated in FIG. 1.

The mandrel 25 is an elongated body having two groove-like portions 26 of reduced diameter. A passage 28 for the supply of pressurized working fluid extends axially through it to cross-bores 30 by which the hydraulic fluid is introduced to a gap 32 between the mandrel 25 and the interior surface of the tube 11. At each end of a pressure zone extending along the mandrel 25 is a sealing device 34 that includes an O-ring 36 and a cylindrical polyurethane back-up member 38, as in the case of the sealing device 15 of the previously known mandrel 12. In this case, however, a sleeve 40 that slides axially on the mandrel 25 is encircled by the backup members 38 and the mandrel 25 serves as a support for the sleeve.

On the high pressure end of the sleeve 40 is a flange 42 that extends radially outwardly adjacent to the O-ring 36. Thus, the back-up member 38 is confined between the flange 42 and an abutment portion 44 of the mandrel 25 at the end of the reduced diameter portion 26. The abutment portion 44 is undercut to provide an annular space 45 into which the sleeve 40 an move axially away from the O-ring 36. It will be noted that while the sleeve 40 can move axially on the mandrel 25, it cannot be cocked, i.e., move angularly, with respect to the mandrel because of its close-sliding fit. The mandrel 25 is disassemblable so that the back-up member 38 and sleeve 40 can be installed.

When working fluid pressure is applied, the O-ring 36 moves a short distance under the force of the fluid, pushing the sleeve 40 axially along the mandrel 25 into the space 45. The back-up member 38 is thus compressed between the flange 42 and the abutment 44 (as indicated by the arrows A in FIG. 5) and caused to expand radially (as indicated by the arrows B). Since the sleeve 40 can move only axially, the flange 42 must apply an equal compressive force about the entire circumference of the back-up member 38. Moreover, since the back-up member 38 fits tightly about the sleeve 40 it cannot move angularly. Therefore, the radial expansion of the back-up member 38 and sleeve 40 will be substantially equal about its entire circumference.

Even if the mandrel 25 is not properly centered within the tube 11 at the time the pressure is initially applied, it is forced to assume a radially centered position defining a substantially uniform extrusion gap 32 due to the uniform expansion of the back-up member 38 in a radial direction. Accordingly, the asymmetrical configuration of the plastically deformed back-up member 18 shown in FIG. 3 is impossible in the case of the back-up member 38 of the present invention.

When the extrusion gap 32 is of a uniform dimension, the maximum gap width to which the back-up member 38 is exposed is only half that encountered in the case of the prior art sealing device 15, assuming that the dimensions of the tube 11 and the hole that receives it are the same in each case. It will, therefore, be found that plastic deformation of the back-up member 38 will not occur in the case of the present invention under circumstances that would result in such deformation if the gap 32 were asymmetrical.

The O-ring 36 and the back-up member 38 are referred to herein as first and second "sealing members" because they cooperate to prevent escape of the working fluid from the pressure zone. It is not to be inferred, however, that the back-up member 38 by itself is necessarily capable of sealing against the inside surface of the tube 11 so as to prevent the escape of fluid.

While a particular form of the invention has been illustrate and described, it will be apparent that various modifications can be made without departing from the spirit and scope of the invention.

I claim:

1. A swaging apparatus for expanding a tube radially comprising:

a mandrel body for axial insertion in said tube to introduce a pressurized working fluid into said tube to cause the radial expansion of said tube;

a deformable sealing member encircling said mandrel body to be compressed axially and expanded radially upon the application of pressure thereto by said working fluid; and centering means for preventing angular movement of said sealing member relative to the longitudinal axis of said tube as said tube expands radially, thereby forcing said sealing member to assume a radially centered position within said tube to define a substantially uniform circumferential extrusion gap adjacent said sealing member;

said centering means comprising a sleeve that is axially slidable on said mandrel body, said sleeve having a flange that extends radially outwardly and said sealing member being confined axially between said flange and a portion of said mandrel.

2. A device for confining a pressurized working fluid within a tube to be expanded radially comprising:

a support to be positioned axially within said tube;

first and second adjacent deformable sealing members encircling said support to be compressed axially and expanded radially upon the application of pressure thereto by said working fluid, said first sealing member being relatively soft compared to said second sealing member; and centering means for preventing angular movement of said second sealing member relative to the longitudinal axis of said support, thereby forcing said second sealing member to assume a radially centered position within said tube as it expands radially and defining a substantially uniform circumferential extrusion gap adjacent said second sealing member.

3. The device of claim 2 wherein said support is part of a mandrel having a passage therein through which said working fluid can be introduced into said tube.

4. The device of claim 2 wherein said centering means is axially slidable on said support.

5. The device of claim 2 wherein said centering means comprises a sleeve that is axially slidable on said support, said sleeve having a flange that extends radially outwardly, said flange being disposed between said first sealing member and said second sealing member.

6. The device of claim 5 wherein said support has a portion of reduced diameter encircled by said sealing members and an abutment at one end of said portion adjacent said second sealing member to prevent axial movement thereof.

7. The device of claim 6 wherein said support is part of a mandrel having a passage therein through which said working fluid can be introduced into said tube.

8. The device of claim 2 wherein said first sealing member is an O-ring.

9. An apparatus for expanding a tube radially within a tube sheet by applying internal fluid pressure, said apparatus including a mandrel to be inserted in said tube having two portions of reduced diameter and an abutment at one end of each of said portions, a passage within said mandrel for introducing pressurized working fluid to said tube, and at least one outlet from said passage between said portions, wherein the improvement comprises two sealing devices each of which is disposed within one of said portions of reduced diameter whereby said working fluid is confined by said sealing devices, each of said sealing devices comprising:

an O-ring encircling said mandrel;

a sleeve encircling said mandrel and axially slidable thereon, said sleeve having a radially outwardly extending flange at one end thereof adjacent said O-ring; and an elastically deformable back-up member encircling said sleeve between said flange and one of said abutments, whereby said working fluid forces said back-up member to be compressed axially and expanded radially against said tube and said sleeve forces said back-up member and said mandrel to assume a radially centered position with respect to said tube as said back-up member expands so that said mandrel is surrounded by a substantially uniform circumferential extrusion gap.

10. A device for confining a pressurized working fluid to a pressure zone within a tube comprising:

a support to be positioned axially within said tube;

a deformable sealing member encircling said support to be compressed axially and expanded radially upon the application of pressure thereto by said working fluid, thereby defining a boundary of said pressure zone; and centering means for applying an axially compressive force to said sealing member from the side thereof on which said pressure zone is located and for preventing angular movement of said sealing member relative to the longitudinal axis of said tube, thereby forcing said sealing member to assume a radially centered position within said tube as said sealing member expands radially and defining a substantially uniform circumferential extrusion gap adjacent said sealing member on the side thereof opposite said pressure zone;

said centering means comprising a sleeve that is axially slidable on said support, said sleeve having a flange on the same side of said sealing member as said pressure zone that extends radially outwardly and said sealing member being confined axially between said flange and a portion of said support.

11. A device for confining a pressurized fluid within a tube comprising:

a support to be positioned axially within said tube;

first and second adjacent deformable sealing members encircling said support to be compressed axially and expanded radially upon the application of pressure thereto by said fluid, said first sealing member being relatively soft compared to said second sealing member; and centering means for preventing angular movement of said second sealing member relative to the longitudinal axis of said support, thereby forcing said second sealing member to assume a radially centered position within said tube as it expands radially and defining a substantially uniform circumferential extrusion gap adjacent said second sealing member;

said centering means comprising a sleeve that is axially slidable on said support and encircled by said second sealing member, said sleeve including means for engaging said second sealing member to apply an axially compressive force thereto.

* * * * *